US006508044B2

(12) United States Patent
Suolahti

(10) Patent No.: US 6,508,044 B2
(45) Date of Patent: Jan. 21, 2003

(54) APPARATUS FOR SETTING A CORNER PROTECTOR ON THE CORNER OF A PACKAGE AND SYSTEM FOR PROTECTING A PACKAGE

(75) Inventor: Yrjo Suolahti, Masku (FI)

(73) Assignee: Oy M. Haloila AB, Masku (FI)

( * ) Notice: Subject to any disclaimer, the term of this patent is extended or adjusted under 35 U.S.C. 154(b) by 0 days.

(21) Appl. No.: 09/892,792

(22) Filed: Jun. 28, 2001

(65) Prior Publication Data

US 2002/0014052 A1 Feb. 7, 2002

(30) Foreign Application Priority Data

Jun. 29, 2000 (FI) ..... 20001546

(51) Int. Cl.[7] ..... B65B 61/00

(52) U.S. Cl. ..... 53/139.7; 53/588; 414/795.6; 414/797

(58) Field of Search ..... 53/139.5, 139.6, 53/139.7, 588, 589; 414/795.4, 795.6, 796.4, 796.5, 796.8, 797, 798.2, 798.4

(56) References Cited

U.S. PATENT DOCUMENTS 3,378,987 A * 4/1968 Lems ..... 100/3
5,226,280 A * 7/1993 Scherer et al. ..... 221/211
5,535,572 A 7/1996 Morantz et al.
5,564,254 A * 10/1996 Thimon et al. ..... 53/139.6

* cited by examiner

*Primary Examiner*—M. D. Patterson
(74) *Attorney, Agent, or Firm*—Lowe Hauptman Gilman & Berner, LLP

(57) ABSTRACT

An apparatus for setting a corner protector on a corner of a package comprises a gripping and positioning device (1) for gripping the corner protector and placing it onto the corner of the package, and a corner protector magazine (2). A storage space (3) in the magazine stores corner protectors arranged as a file. Conveying means (7–10) move the file in the storage space toward the delivery end. A gate (11) has been arranged to be moved between a closed position (II) and an open position (I). An arresting device (13) is provided with a separating tab (14) which moves between an arresting position (A) and a releasing position (B). In the arresting position (A), the separating tab is between the foremost corner protector ($4^1$) in the file and the second corner protector ($4^2$) next in the file so as to arrest the file of corner protectors while the gate (11) is in the open position (II). In the releasing position (B) the separating tab is out of the way of the corner protector ($4^2$) when the gate is in the closed position (I) so as to release the second corner protector to make it the foremost corner protector in the file so that it is pressed against the closed gate while the previous foremost corner protector is in the grip of the gripping and positioning device.

14 Claims, 12 Drawing Sheets

Figure 1:
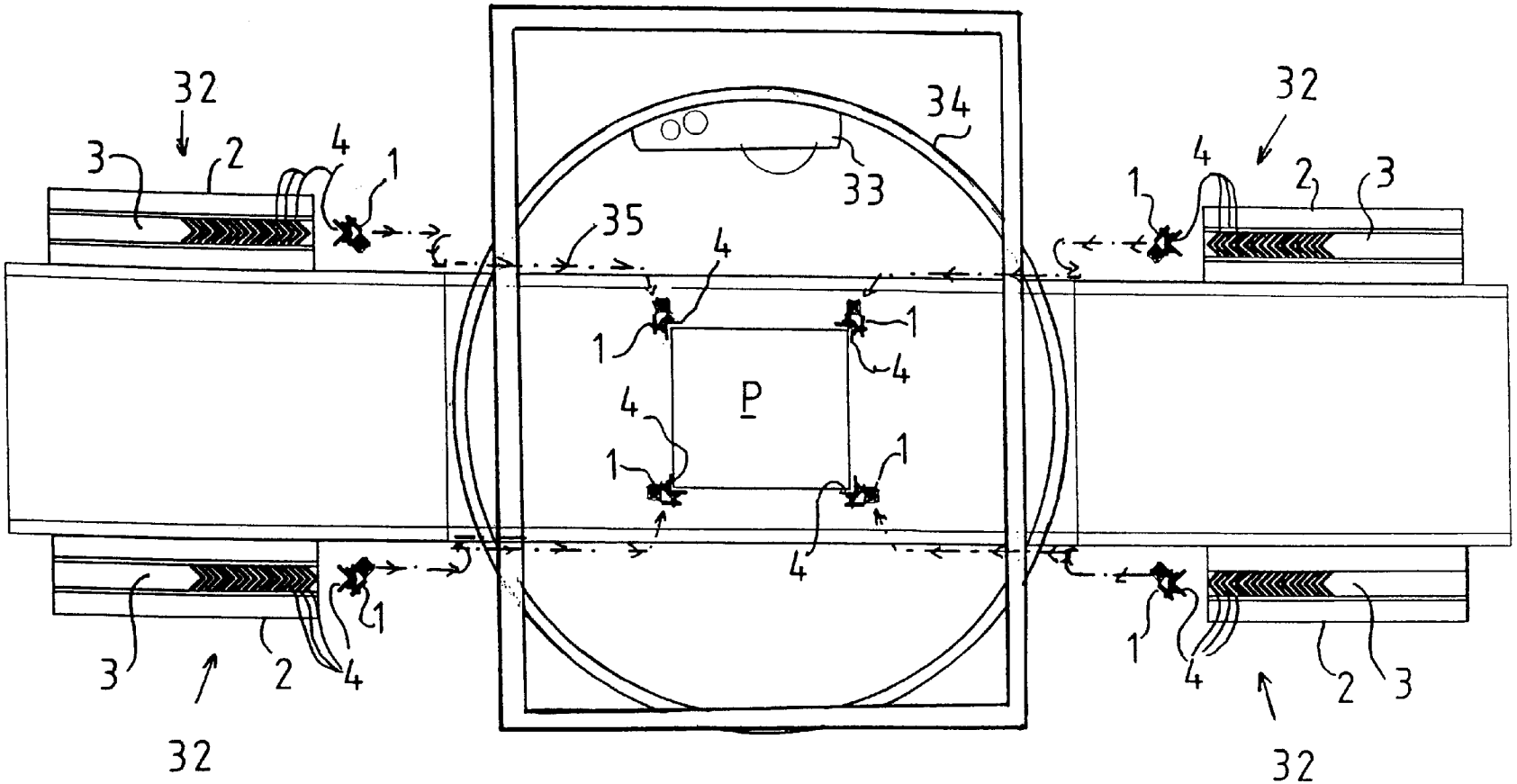

APPARATUS FOR SETTING A CORNER PROTECTOR ON THE CORNER OF A PACKAGE AND SYSTEM FOR PROTECTING A PACKAGE

The purpose of a corner protector (e.g. on a loaded pallet), in addition to protecting the corners, is to function as a rigid vertical support at the corners of a package so that when packages are piled on top of each other, the corner protectors at their corners bear a substantial part of the load while the package itself is not subjected to a large load. Usually the corner protector is a rigid corner profile made of laminated cardboard, having two flanges at right angles to each other. The package is usually of a rectangular shape as seen from above, so it has four right-angled corners to be protected.

Previously known e.g. from specification U.S. Pat. No. 5,535,572 are devices for setting corner protectors on the corners of a package before the package is wrapped with a web of plastic film.

Previously known devices have a gripping and positioning device which grips a corner protector and moves it onto a corner of the package. A number of corner protectors are placed in a sequence in a vertical position in a storage space of a corner protector magazine. The gripping and positioning device picks one corner protector at a time from the delivery end of the storage space. The corner protector magazine is also provided with conveying means for shifting the file of corner protectors in the storage space toward the delivery end. Placed near the delivery end are arresting means to prevent the corner protectors from accidentally falling down from the delivery end.

The device presented in specification U.S. Pat. No. 5,535,572, which represents the closest state of the art with respect to the object of the present application, comprises a corner protector magazine containing a pair of conveyor belts placed at a vertical distance from each other, between which the corner protectors are held in a vertical position by their upper and lower ends by the belts. The belts, driven simultaneously at the same speed, move the corner protectors in a file toward the delivery end against a suction pad gripper, which takes the corner protector to a corner of the package.

The device of specification U.S. Pat. No. 5,535,572 is additionally provided with an arrester at the delivery end, which is designed to separate the corner protectors from each other and to prevent them from falling down from the belts before being gripped by the gripping means. Moreover, the apparatus can be adjusted to allow corner protectors of different lengths to be conveyed, by adjusting the height position of the upper conveyor in relation to the lower conveyor.

As the conveyors are in contact with the ends of the corner protectors, there is the problem that the corner protectors being moved as a file are required to be substantially equal in length. In practice, however, corner protectors commercially available are not exactly of equal length; instead, the variation in their length may be of the order of ±4 mm. The apparatus has a very limited range of adjustment for different corner protector lengths. In the above-mentioned apparatus, the arresters at the delivery end of the conveyors are bending springs disposed on either side of the upper and lower conveyors and crossing the path of the corner protectors so as to prevent them from falling down from the delivery end. The corner protectors are usually composed of strips of cardboard glued together on top of each other. Often some glue has flown out from between the layers, with the result that successive corner protectors in the file are glued together. A problem with this prior-art apparatus is that the weak springs can not reliably separate corner protectors thus glued together, so that when the foremost corner protector in the file is gripped by the gripping and positioning device, one or more of the corner protectors following it in the file may be picked up together with it.

The object of the invention is to eliminate the problems referred to above.

A specific object of the invention is to disclose an apparatus that involves no limitation regarding the length of the corner protectors to be handled.

A further object of the invention is to disclose an apparatus that is able to reliably separate corner protectors sticking together so that the gripping and positioning device will only take one corner protector at a time.

According to the invention, the conveying means comprise a press device driven by a first power means and arranged to be in contact with the hindmost corner protector in the file of corner protectors to move the file of corner protectors toward the delivery end and to press it so as to make it substantially compact. The arresting means comprise a gate arranged to be moved between a closed position and an open position by a second power means. In the closed position, the gate holds the file of corner protectors against the pressure applied by the press device as the foremost corner protector is leaning against the gate. In the open position of the gate, the foremost corner protector can be taken by the gripping and positioning device. Moreover, the arresting means comprise a separating tab fitted to be moved by a third power means between an arresting position and a releasing position. In the arresting position, the separating tab is between the foremost corner protector in the file and the second corner protector next in the file so as to hold the file of corner protectors against the pressure of the press device when the gate is in the open position. When the gate is in the closed position, the separating tab is in the releasing position out of the way of the corner protector so as to release the second corner protector to make it the foremost corner protector in the file so that it is pressed against the closed gate while the previously foremost corner protector is in the grip of the gripping and positioning device.

The invention is preferably applied in a system comprising a wrapping apparatus for winding a film web around a package and above-mentioned devices according to the invention for setting corner protectors on the corners of the package before its being wrapped by the wrapping apparatus. The number of such devices corresponds to the number of corners in the package.

The invention provides the advantage that the apparatus is able to handle corner protectors of widely varying lengths without having to be separately adjusted to accommodate different corner protector lengths. A further advantage of the invention is that, via interaction between a press bar, a gate and a separating tab, the apparatus can also reliably separate corner protectors sticking together. In addition to the aforementioned length tolerance, the corner protectors also have other tolerances. The thickness of the flanges may vary somewhat, and the angle between the flanges may not be exactly 90°. To ensure that the interstice between the flanges of the two foremost corner protectors will exactly coincide with the point where the separating tab is thrust into said interstice, the press device presses the corner protectors against the gate, compacting them into a tight pack, thus shaping the corner protectors so that the interstice between the flanges of the two foremost corner protectors will be exactly aligned with the separating tab.

In an embodiment of the apparatus and system, the press device comprises an elongated vertical press bar fitted to push the file of corner protectors from behind in relation to its direction of movement and a detector for detecting the pressing force of the press bar.

In an embodiment of the apparatus and system, the first power means is so controlled that it will move the press bar toward the delivery end on the basis of the compressive force detected by the detector when the compressive force falls below a predetermined limit value. Thus, the file of corner protectors remains all the time a compact pack.

In an embodiment of the apparatus and system, the gate comprises two gate parts and an upright swiveling axis for each gate part to allow them to be turned about the swiveling axis between a closed position and an open position.

In an embodiment of the apparatus and system, the gate parts are at right angles to each other when in the closed position, corresponding to the right angle of the corner protector, and substantially at an angle of about 45° with respect to the direction of movement of the file of corner protectors.

In an embodiment of the apparatus and system, the swiveling axes are connected to each other so as to allow them to be turned by a single common second power means.

In an embodiment of the apparatus and system, the arresting device comprises two separating tabs disposed on different sides of the file of corner protectors.

In an embodiment of the apparatus and system, the separating tab is a knife-like plate. The sharp edge of the knife-like plate can easily penetrate between the flanges of the corner protectors.

In an embodiment of the apparatus and system, the third power means comprises a first shaft element which is movable in a reciprocating manner and to which the separating tab is attached, said first shaft element being designed to be movable substantially at an angle of about 45° with respect to the direction of motion of the file of corner protectors, in a direction corresponding to the direction of the flange of the corner protector.

In an embodiment of the apparatus and system, the apparatus comprises lateral supports disposed at the height of a distance from a bottom support to support the file of corner protectors in a lateral transverse direction from opposite sides.

In an embodiment of the apparatus and system, the distance between the lateral supports is adjustable to adapt the apparatus for corner protectors of different sizes in respect of width.

In an embodiment of the apparatus and system, the detector comprises an elongated boss disposed on the front side of the press bar in the direction of movement of the file of corner protectors so that it touches the hindmost corner protector in the file, said boss being pivotally connected to one end of the press bar; a spring for forcing the boss away from the press bar in said direction of movement; a second shaft element arranged to be movable in a direction perpendicular to the longitudinal direction of the press bar; and a limit switch arranged to switch on the basis of a predetermined displacement of the second shaft element.

In an embodiment of the apparatus and system, the front side of the boss, which touches the hindmost corner protector, comprises two planar stop faces at right angles to each other, corresponding to the right angle of the corner protector.

Figure 2:
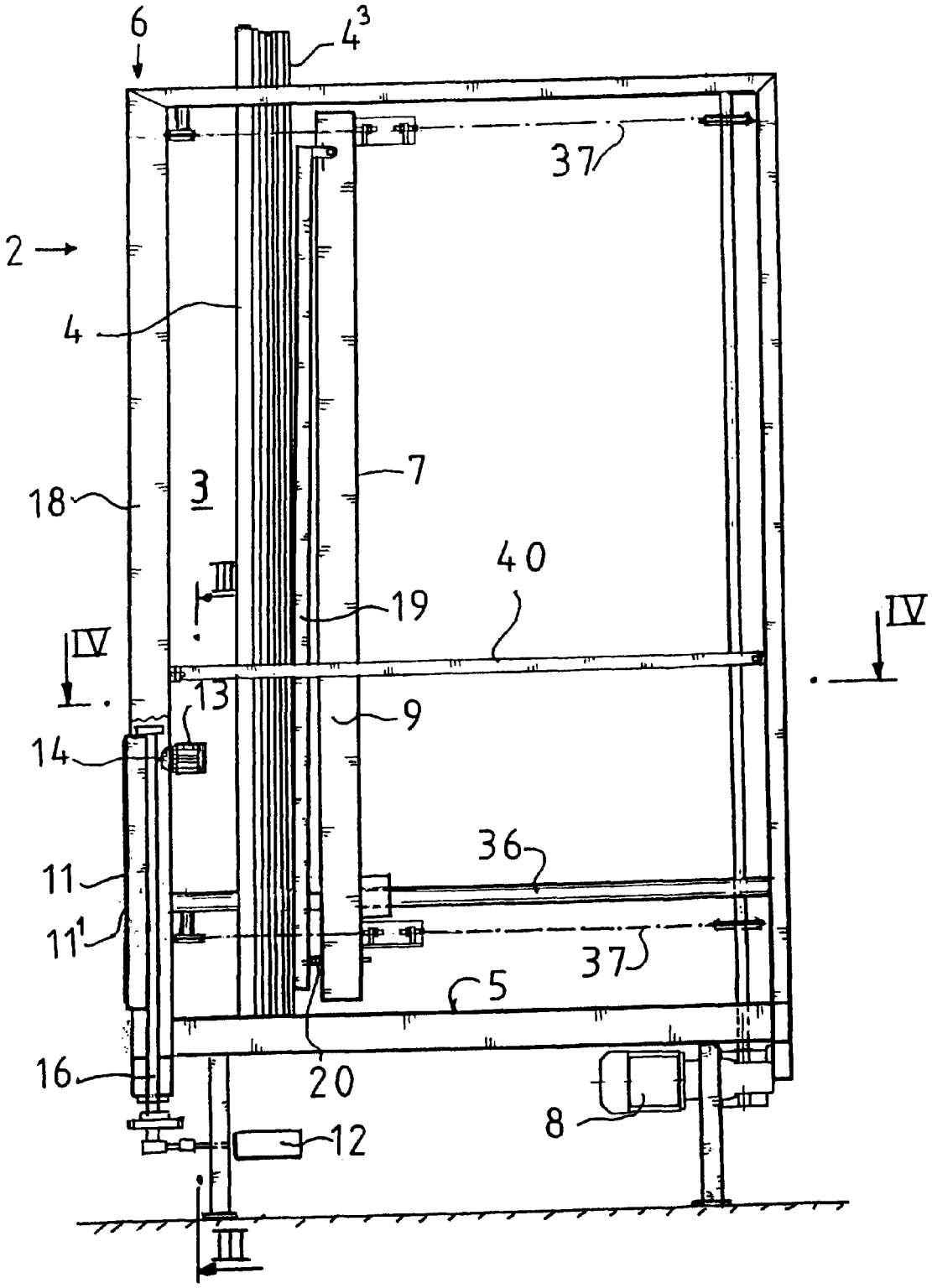
Figure 3:
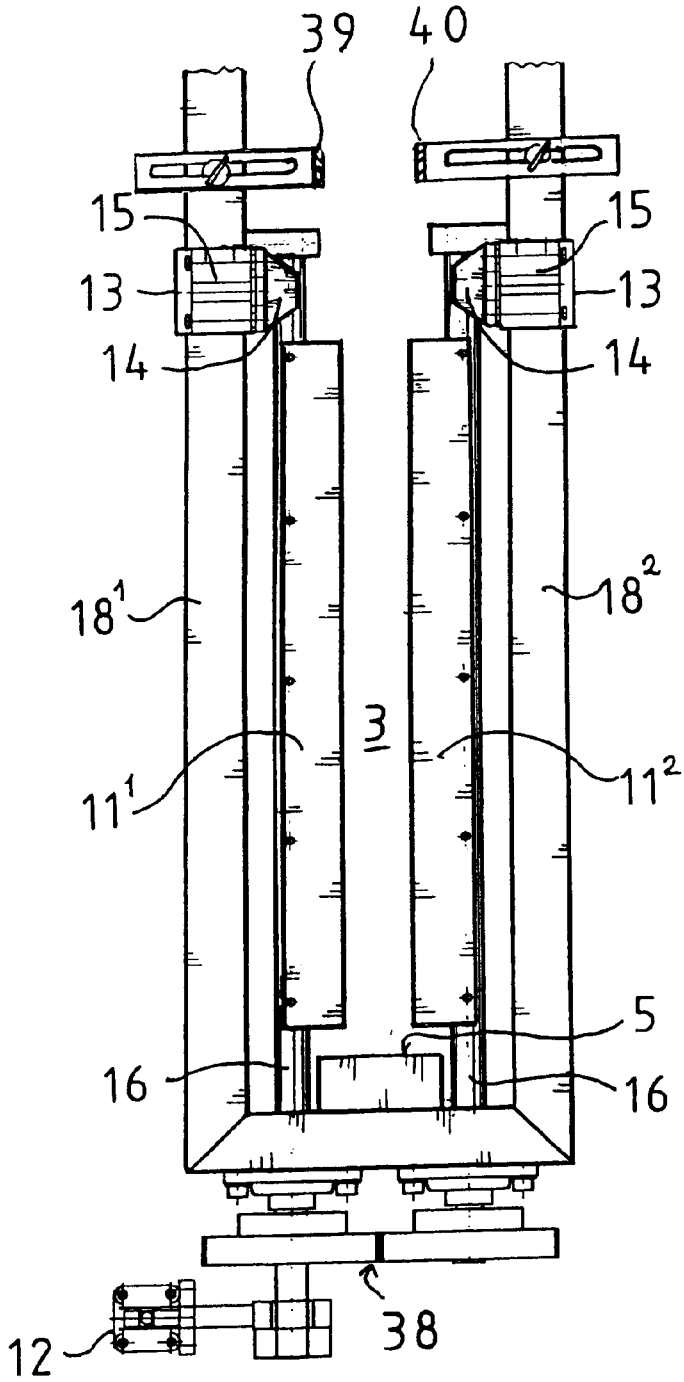
Figure 4:
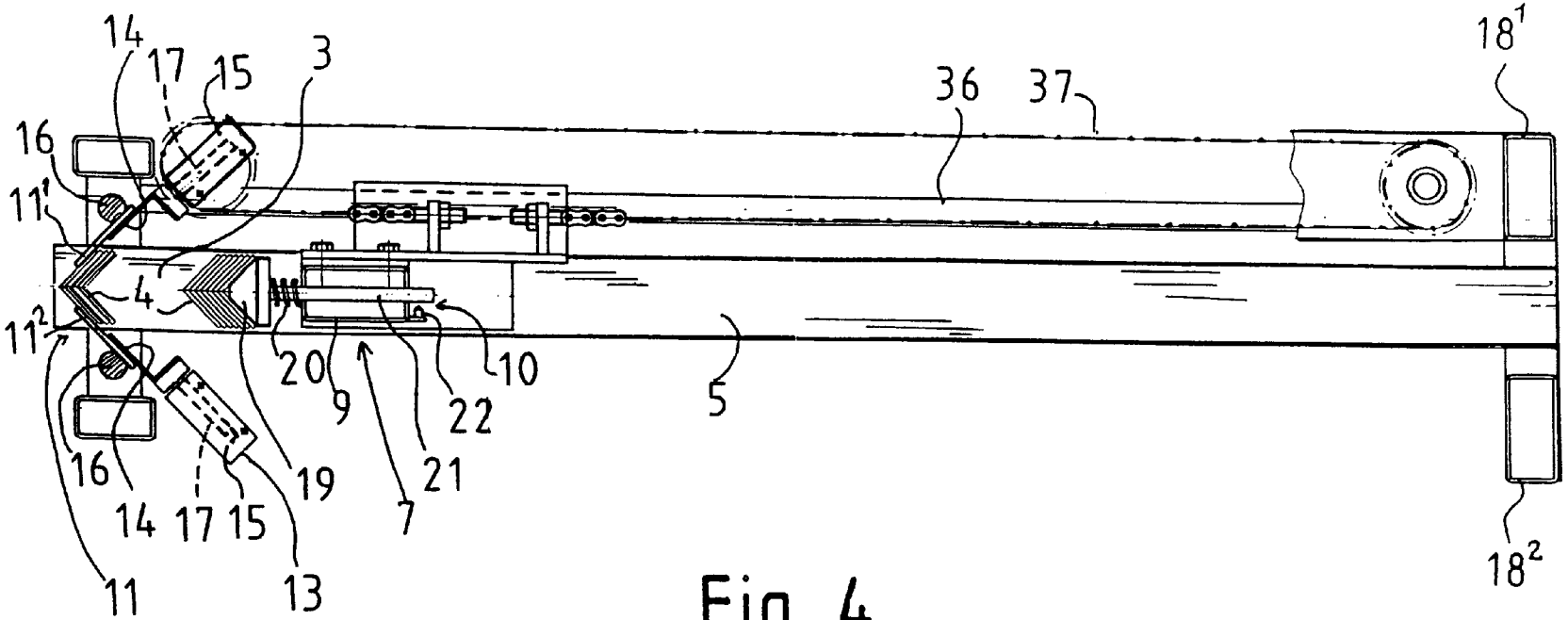

In the following, the invention will be described in detail by the aid of a few examples of its embodiments with reference to the drawing, wherein FIG. 1 presents a layout view of an embodiment of the system of the invention, FIG. 2 presents a corner protector magazine comprised in an embodiment of the invention in dia-grammatic side view, FIG. 3 presents a section along line III—III through the corner protector magazine in FIG. 2, FIG. 4 presents a section along line IV—IV through the corner protector magazine in FIG. 2, and FIGS. 5–12 illustrate different phases of the operation of the apparatus presented in FIGS. 2–4 as seen from a direction corresponding to FIG. 4.

FIG. 1 shows a top view of a system for protecting a four-cornered package P. The system consists of an ordinary wrapping apparatus 31 and devices 32 for positioning corner protectors. In the wrapping apparatus 31, a plastic film to be wound around the package is delivered from a film dispenser carriage 33, which revolves about the package P along a circular wrapping ring 34. The wrapping operation is only started after corner protectors 4 have been placed on the four corners of the package. For placing the corner protectors, the system comprises four devices 32 disposed near the corners of the package at a distance from the wrapping apparatus.

Each device 32 comprises a gripping and positioning device 1, which is shown in FIG. 1 in diagrammatic form without its control mechanisms, and a corner protector magazine 2. The gripping and positioning devices 1 take a corner protector 4 from each corner protector magazine 2 and move them to the corners of the package P, as indicated by arrows 35.

As shown in FIGS. 1–4, the corner protector magazine 2 comprises a storage space 3 where corner protectors can be placed in an upright position in sequence to form a file resting on a bottom support 5. The gripping and positioning device 1 takes a single corner protector 4 from the delivery end 6 of the storage space 3. Conveying means 2 provided in the corner protector magazine 2 move the file of corner protectors in the storage space 3 toward the delivery end 6. The delivery end 6 is also provided with arresting means designed to prevent the corner protectors from falling down from the delivery end 6, to ensure that the gripping and positioning device 1 will only take one corner protector and to separate corner protectors that may stick together. As illustrated in FIGS. 3 and 4, the device comprises a framework 18 consisting of two frames $\mathbf{18}^1$ and $\mathbf{18}^2$ disposed at a distance from each other. Mounted on the frames are horizontal, mutually parallel lateral supports 39 and 40, which are placed at the height of a distance from the bottom support 5. The lateral supports 39, 40 support the file of corner protectors laterally from opposite sides. As illustrated in FIG. 3, the distance between the lateral supports 39, 40 can be adjusted to accommodate corner protectors of different widths.

As can be best seen from FIGS. 2 and 4, the conveying means comprise a press device 7 provided with a first power means 8 and arranged to be in contact with the hindmost corner protector $\mathbf{4}^3$ in the file of corner protectors. The press device 7 presses the corner protectors in the storage space 3 into a substantially compact pack. The press device 7 comprises an elongated vertical press bar 9, which pushes the file of corner protectors from behind with respect to the direction of its movement. The press bar 9 moves horizontally as guided by a horizontal guide bar 36. The press bar 9 is driven via a chain transmission 37 coupled to the first power means 8.

The press bar 9 is provided with a detector 10 for detecting the pressing force. The first power means 8 is so controlled that it will move the press bar 9 toward the delivery end 6 when the detector 10 detects a pressing force below a predetermined limit value.

As shown in FIGS. 2 and 4, the detector 10 comprises an elongated boss 19 disposed on the front side of the press bar 9 in the direction of movement of the file of corner protectors so that it touches the hindmost corner protector $4^3$. The boss is pivotally connected to the upper end of the press bar. At the lower end there is a spring 20 which forces the boss away from the press bar toward the file of corner protectors. A second shaft element 21 going through the press bar 9 has been arranged to be movable in a direction perpendicular to the longitudinal direction of the press bar. Placed on the other side of the press bar 9 is a limit switch 22, which switches on the basis of a predetermined displacement of the second shaft element 21.

The forward side of the boss 19, which touches the hindmost corner protector $4^3$ in the file of corner protectors, is provided with two planar stop faces 23, 24 at right angles to each other, corresponding to the right angle of the corner protector 4.

As can be seen from FIGS. 3 and 4, the arresting means consist of an openable and closeable gate 11 and an arresting device 13. The gate comprises two plate-like gate parts $11^1$, $11^2$ and two vertical swiveling axes 16, to which the gate parts are so attached that they can be turned about the vertical axis between a closed position I and an open position II. In the closed position shown in FIG. 4, the gate parts $11^1$, $11^2$ are at right angles to each other, corresponding to the right angle of the corner protector 4, and at an angle of 45° with respect to the direction of displacement of the file of corner protectors. In the open position II (see FIG. 10), the gate parts are parallel to each other. From FIG. 3, it can be seen that the swiveling axes 16 are coupled together via a gear transmission 38 so that they are turned simultaneously by a common power means 12, which may be e.g. a pneumatic cylinder with its piston rod connected to a swinging bracket extending from the lower end of one of the swiveling axes.

In the closed position I of the gate 11, the gate holds the corner protector file against the pressure of the press device, with the foremost corner protector $4^1$ leaning against the gate. In the open position II of the gate 11, the foremost corner protector in the file is free to be taken by the gripping and positioning device 1.

To ensure that the second corner protector behind the first one as well as the rest of the file will remain in place and that the foremost and the second corner protectors are released from each other, the arresting device 13 comprises two separating tabs 14 disposed on opposite sides of the file of corner protectors. The separating tab 14 is a knife-like plate. The third power means 17 actuating the plate consists of a double-action pneumatic cylinder having a first shaft element 20, to which the separating tab 14 is attached. The first shaft element 20 is moved at an angle of 45° relative to the direction of displacement of the file of corner protectors, corresponding to the orientation of the flange of the corner protector 4.

In the arresting position A (see FIGS. 7–9), the separating tab 14 is between the foremost corner protector $4^1$ and the next or second corner protector $4^2$ in the file, holding the file of corner protectors while the gate 11 is in the open position II. In the releasing position B, the separating tab is out of the way of the corner protectors when the gate 11 in the closed position I.

In the following, the operation of the apparatus will be described in greater detail with reference to FIGS. 5–12.

Figure 5:
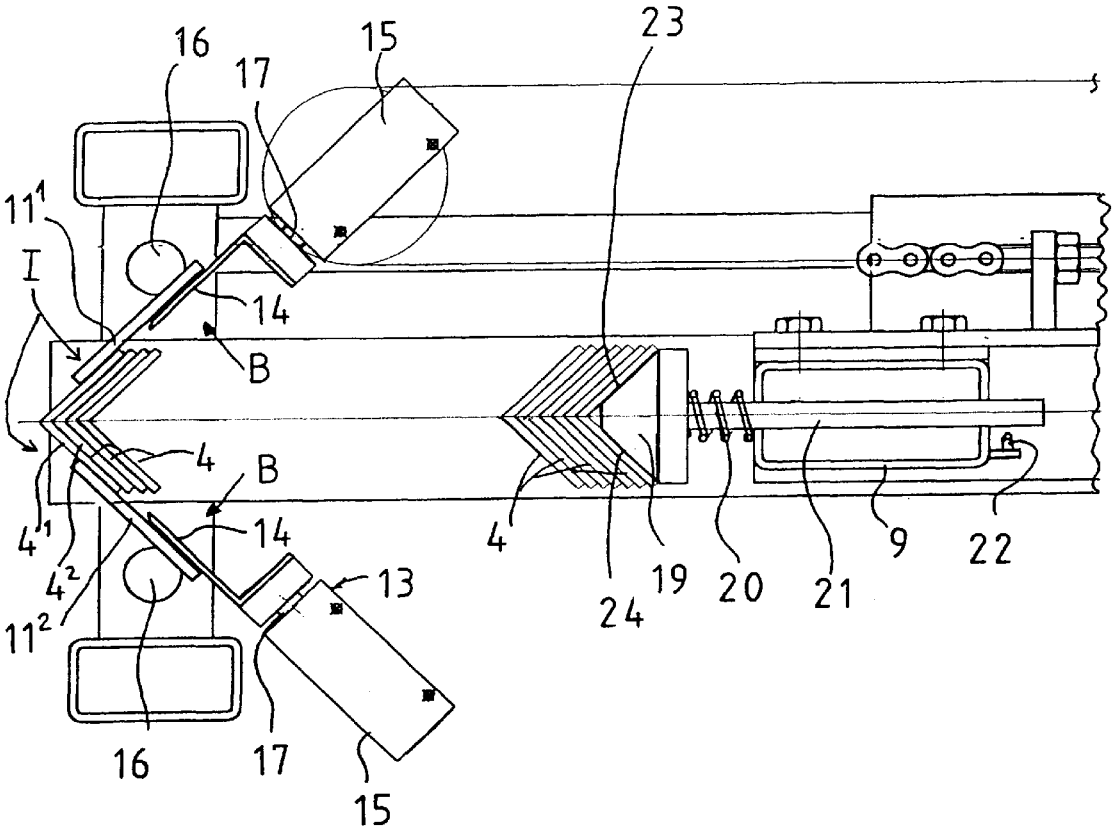

In FIG. 5, the gate parts $11^1$, $11^2$ are in the closed position I and the separating tabs 14 are in the releasing position B, and corner protectors 4 can be entered into the storage space 3.

Figure 6:
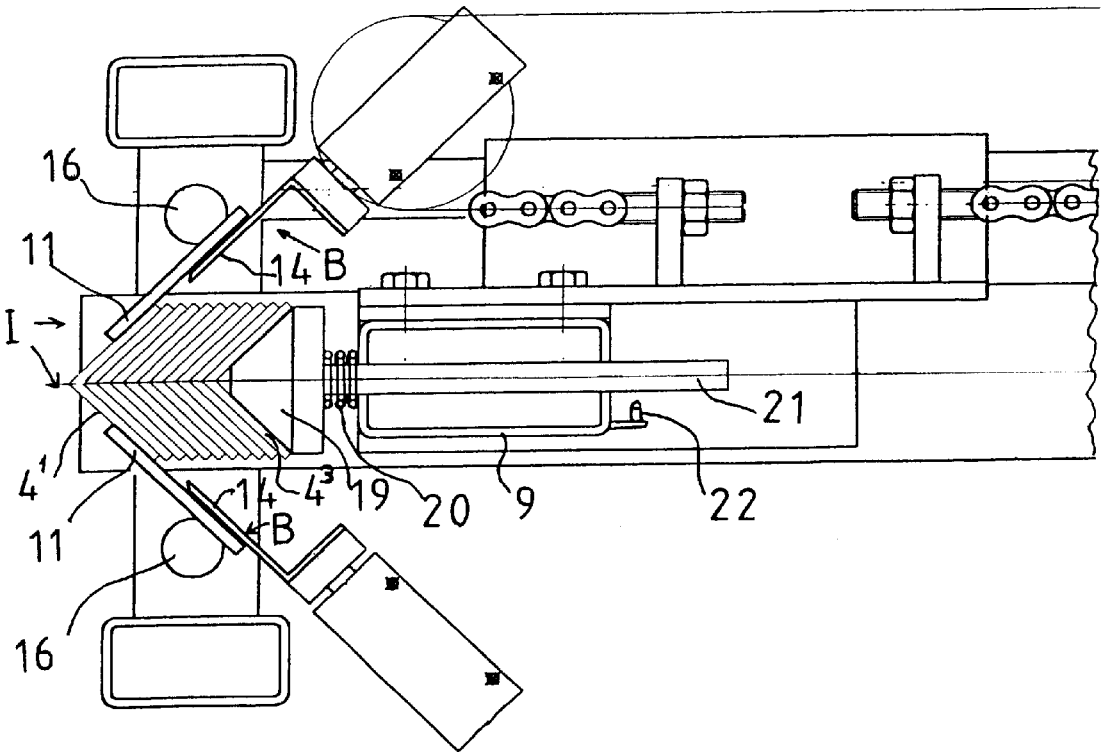

In FIG. 6, the corner protectors 4 have been pressed by the press bar 9 against the gate so that they form a compact file. The boss 19 has moved toward the press bar 9 and the spring 20 between them has been compressed. The power means 8 driving the press bar 9 is controlled by the limit switch 22 so that the power means will move the press bar 9 toward the delivery end so as to generate a sufficient pressing force.

Figure 7:
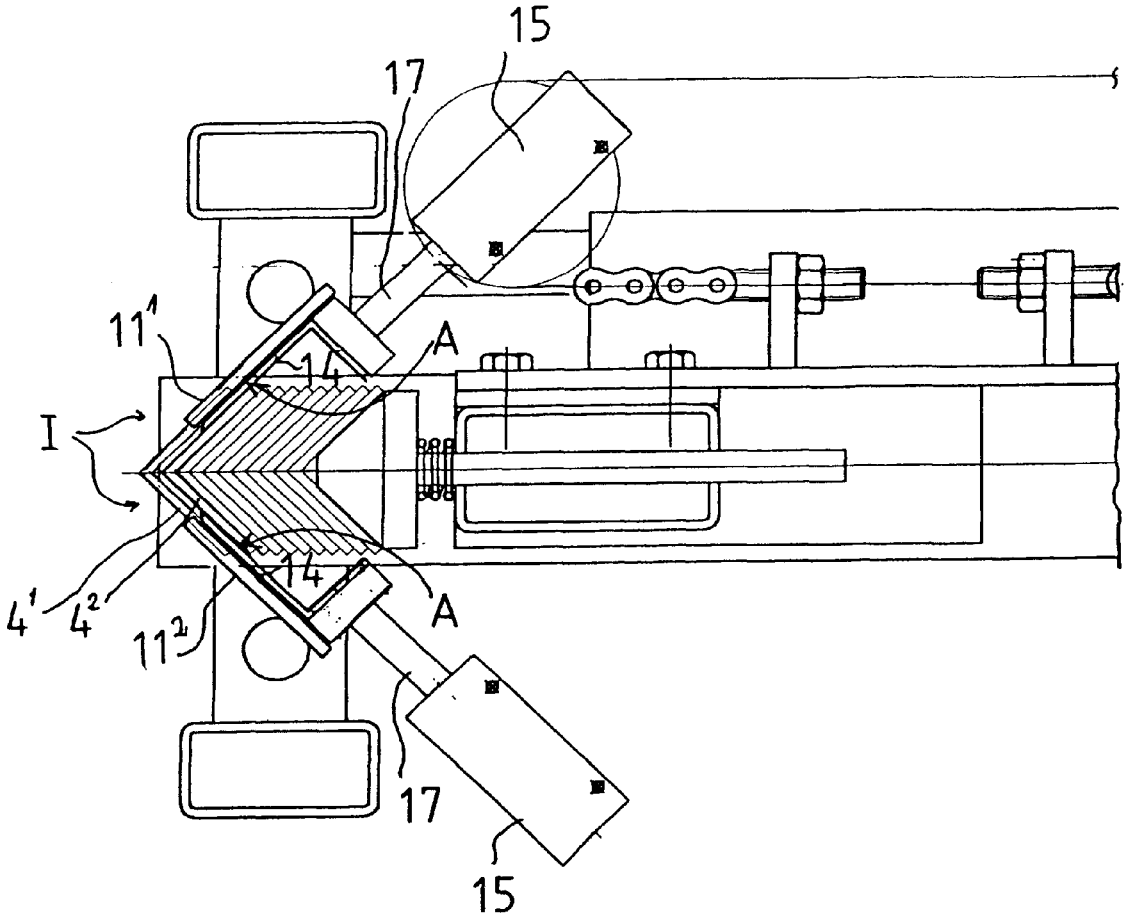

In FIG. 7, the separating tabs 14 have been thrust between the first $4^1$ and second $4^2$ corner protectors from both sides so that the separating tabs 14 are now in the arresting position A while the gate 11 remains in the closed position I.

Figure 8:
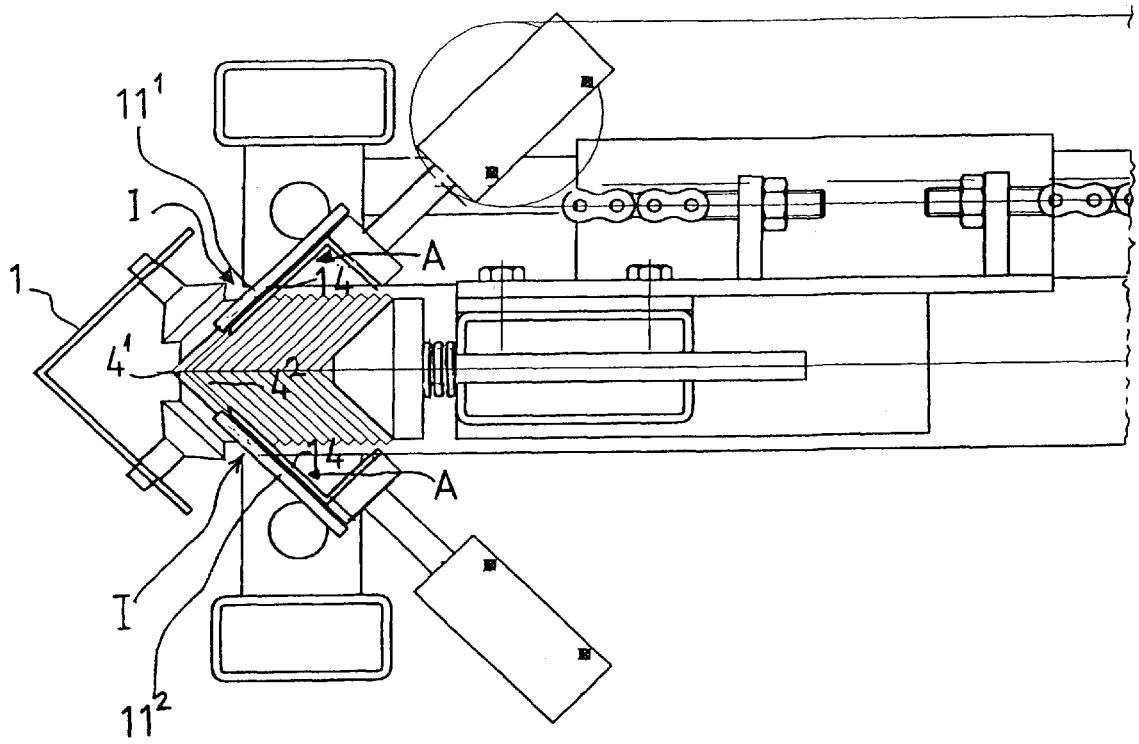

In FIG. 8, the suction pad gripping elements of the gripping and positioning device 1 have been brought into engagement with the surface of the foremost corner protector $4^1$ while the separating tabs 14 remain in the arresting position A and the gate 11 remains in the closed position I.

Figure 9:
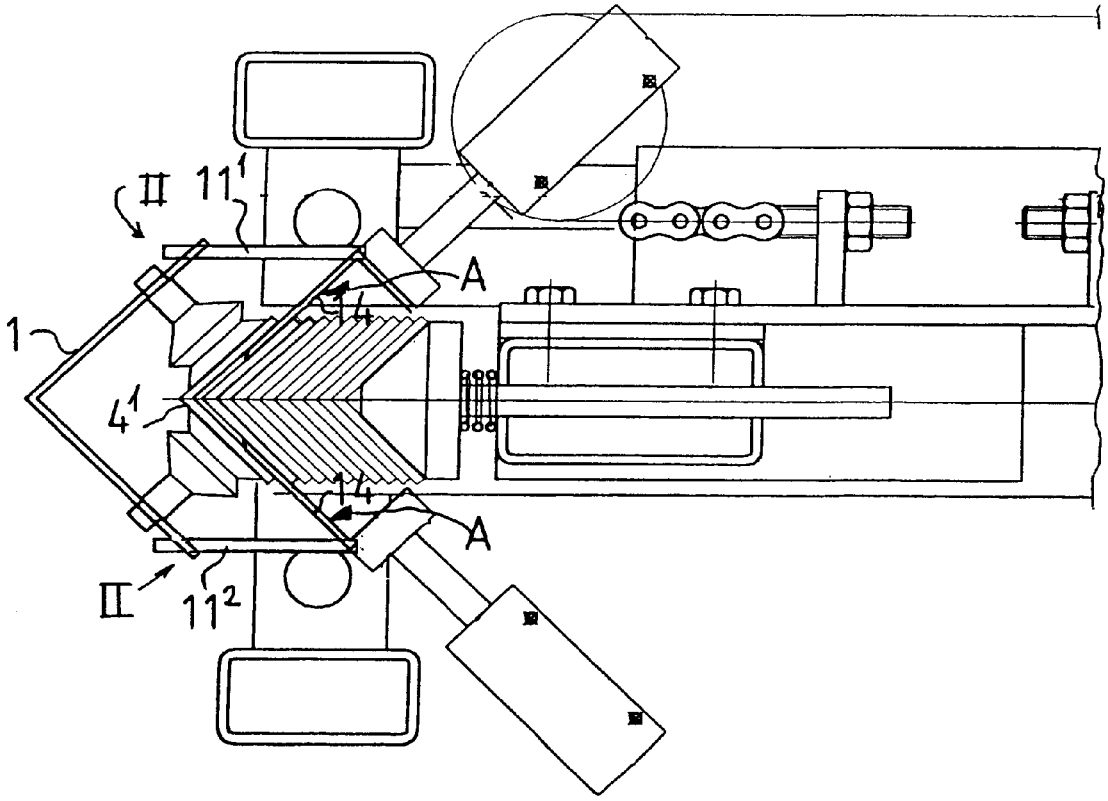
Figure 10:
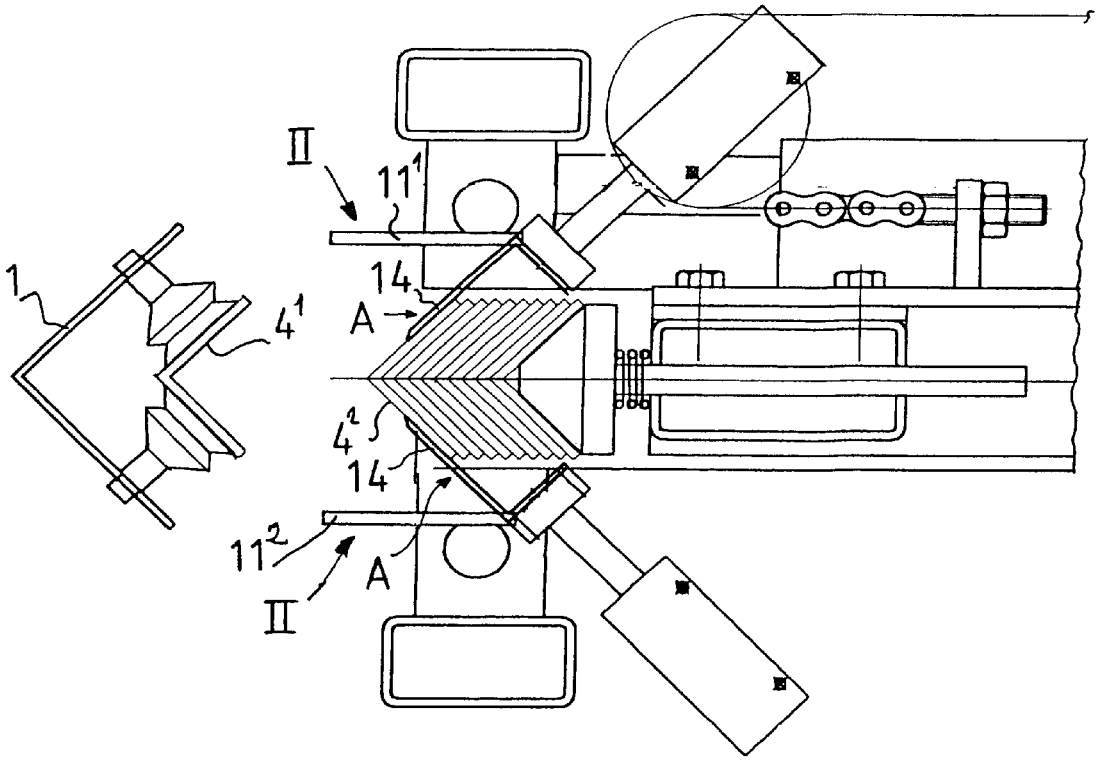

In FIG. 9, the gate parts $11^1$, $11^2$ have been turned into the open position II, so the gripping and positioning device 1 is able to take away corner protector $4^1$, as shown in FIG. 10. The separating tabs 14 remaining in the arresting position A obstruct the way of corner protector $4^2$, preventing removal of other corner protectors.

Figure 11:
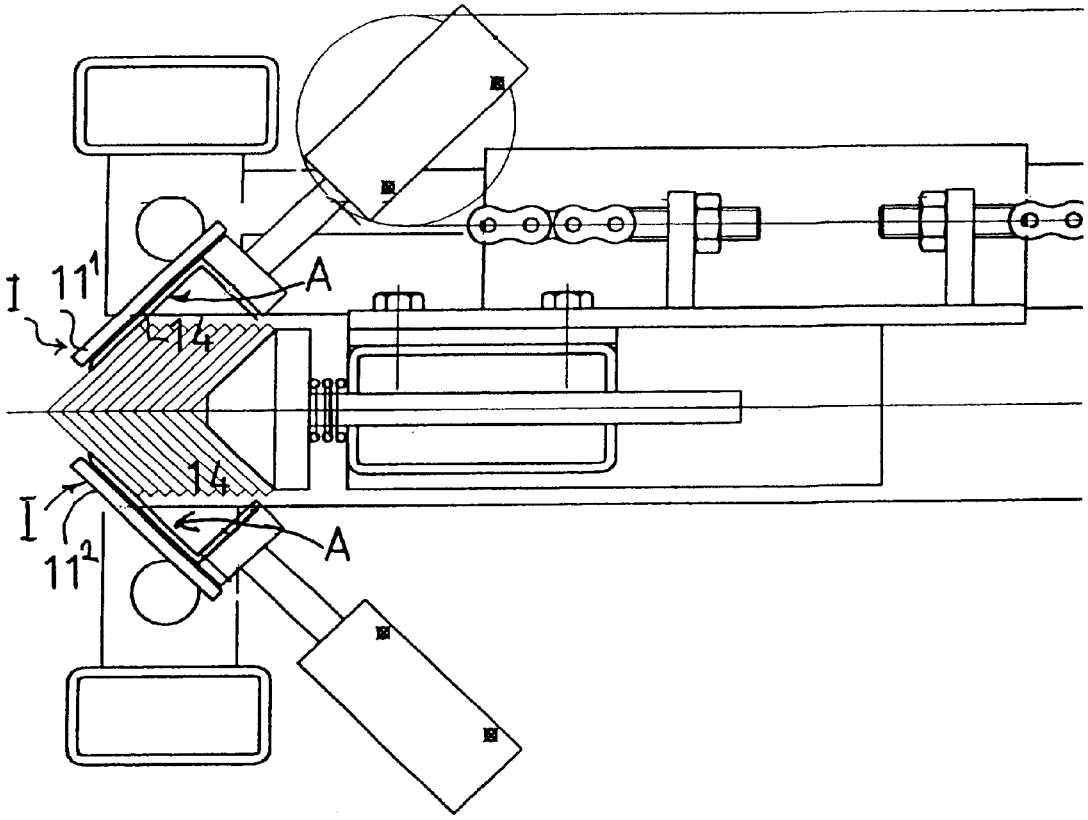

In FIG. 11, the gate parts $11^1$, $11^2$ have been turned back into the closed position I while the separating tabs 14 remain in the arresting position A. The corner protector 4 that was previously the second one in the file is now the foremost one.

Figure 12:
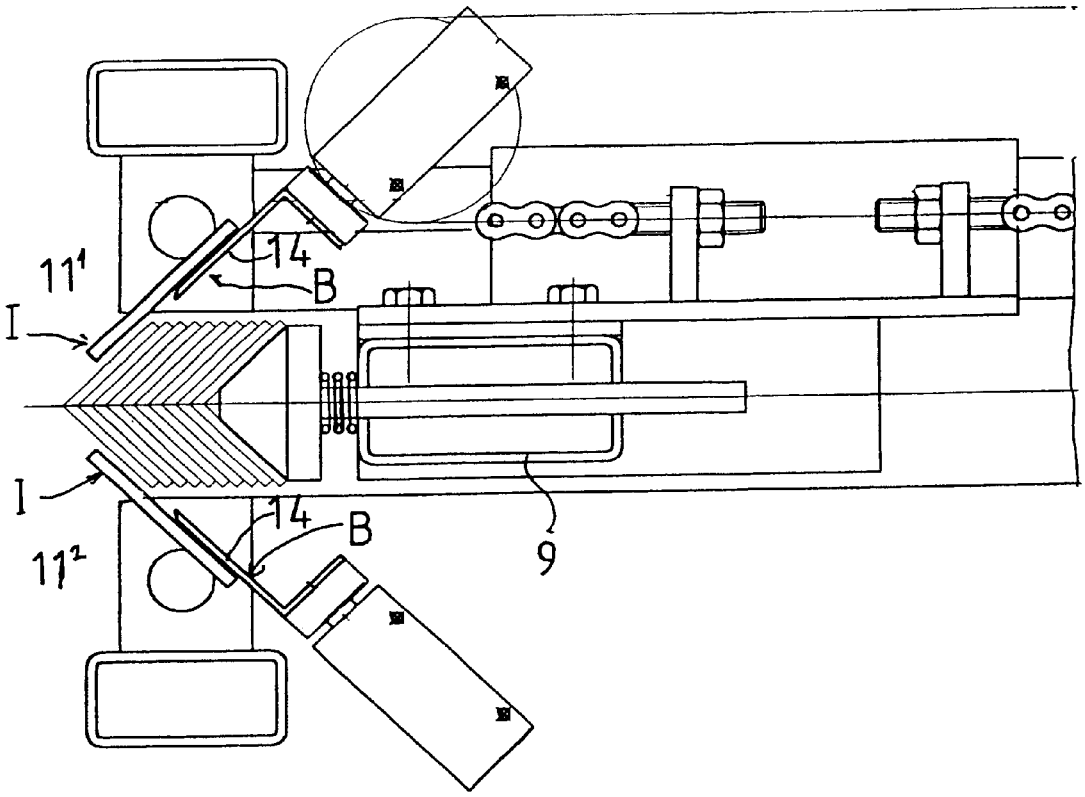

In FIG. 12, the separating tabs 14 have been retracted to the releasing position B so that the foremost corner protector in the file can be pressed against the gate parts $11^1$, $11^2$. As the pressing force of the press bar 9 is reduced, the press bar is automatically moved toward the gate parts until a sufficient pressing force is reached. The situation is then the same as that illustrated in FIG. 6.

The invention is not restricted to the examples of its embodiments described above; instead, many variations are possible within the scope of the inventive idea defined in the claims.

I claim:

1. Apparatus (32) for setting a corner protector (4) on a corner of a package (P), said apparatus comprising a gripping and positioning device (1) for gripping the corner protector and moving it to the corner of the package, and a corner protector magazine (2) comprising a storage space (3) designed to store a number of corner protectors (4; $4^1$, $4^2$, $4^3$) arranged as a file in an upright position, said storage space being delimited in the downward direction by a bottom support (5) which supports the corner protectors from below, said storage space comprising a delivery end (6) from where an individual corner protector can be taken by the gripping and positioning device; conveying means (7, 8, 9, 10) for moving the file of corner protectors in the storage space toward the delivery end; and arresting means (11, 12, 13, 14, 15) arranged near the delivery end to arrest the corner protectors, characterized in that:

the conveying means comprise a press device (7) driven by a first power means (8) and arranged to be in contact with the hindmost corner protector ($4^3$) to move the file of corner protectors toward the delivery end (6) and to pack the corner protectors in the file substantially closely together;

and that the arresting means comprise:

a gate (11) which can be opened and closed, with an arrangement for moving the gate between a closed position (I) and an open position (II) using a second power means (12), in which closed position (I) the gate detains the file of corner protectors against the pressure applied by the press device as the foremost corner protector ($4^1$) leans against the gate, and in which open position (II) the gate is open so as to release the foremost corner protector to allow it to be taken by the gripping and positioning device, and an arresting device (13) disposed near the delivery end (6) and comprising a separating tab (14) fitted to be moved by a third power means (15) between an arresting position (A) and a releasing position (B) in which arresting position (A) the separating tab is between the foremost corner protector ($4^1$) in the file and the second corner protector ($4^2$) next in the file so as to arrest the file of corner protectors while the gate (11) is in the open position (II), and in which releasing position (B) the separating tab is out of the way of the corner protector ($4^2$) when the gate is in the closed position (I) so as to release the second corner protector to make it the foremost corner protector in the file so that it is pressed against the closed gate while the previous foremost corner protector is in the grip of the gripping and positioning device.

2. Apparatus as defined in claim 1, characterized in that the press device (7) comprises an elongated upright press bar (9) fitted to push the file of corner protectors from behind in relation to its direction of movement and a detector (10) for detecting the pressing force of the press bar.

3. Apparatus as defined in claim 2, characterized in that the first power means (8) is so controlled that it will move the press bar (9) towards the delivery end (6) when the compressive force detected by the detector (10) falls below a predetermined limit value.

4. Apparatus as defined in claim 1, characterized in that the gate comprises two gate parts; and two upright swiveling axes to which the gate parts are attached so as to allow them to be turned between a closed position and an open position.

5. Apparatus as defined in claim 4, characterized in that the gate parts ($11^1$, $11^2$) are at right angles to each other when in the closed position (I), corresponding to the right angle of the corner protector (4), and substantially at an angle of about 45° with respect to the direction of movement of the file of corner protectors.

6. Apparatus as defined in claim 4, characterized in that the swiveling axes are connected to each other so as to allow them to be turned by a single common second power means.

7. Apparatus as defined in claim 1, characterized in that the arresting device comprises two separating tabs disposed on different sides of the file of comer protectors.

8. Apparatus as defined in claim 7, characterized in that the separating tab (14) is a knife-like plate.

9. Apparatus as defined in claim 1, characterized in that the third power means comprises a first shaft element which is movable in a back-and-forth manner and to which the separating tab is attached, said first shaft element being designed to be movable substantially at an angle of about 45° with respect to the direction of motion of the file of comer protectors, in a direction corresponding to the direction of the flange of the comer protector.

10. Apparatus as defined in claim 1, characterized in that the apparatus comprises lateral supports disposed at the height of a distance from the bottom support to support the file of comer protectors laterally from opposite sides.

11. Apparatus as defined in claim 10, characterized in that the distance between the lateral supports (39, 40) is adjustable to adapt the apparatus for corner protectors of different sizes in respect of width.

12. Apparatus as defined in claim 1, characterized in that the detector comprises an elongated boss disposed on the front side of the press bar in the direction of movement of the file of comer protectors so that it touches the hindmost corner protector, said boss being pivotal connected to one end of the press bar; a spring for forcing the boss away from the press bar in said direction of movement; a second shaft element arranged to be movable in a direction to the longitudinal direction of the press bar; and a limit switch arranged to switch on the basis of a predetermined displacement of the second shaft element.

13. Apparatus as defined in claim 11, characterized in that the front side of the boss (19) which touches the hindmost corner protector ($4^3$) in the file of corner protectors comprises two planar stop faces (23, 24) at right angles to each other, corresponding to the right angle of the corner protector (4).

14. System for protecting a package (P) having corners, said system comprising a wrapping apparatus (31) for winding a foil web around the package, and devices (32) for setting corner protectors on the corners of the package before it is wrapped by the wrapping apparatus, the number of said devices corresponding to the number of corners in the package, each one of said devices (32) comprising a gripping and positioning device (1) for gripping a corner protector and moving it to a corner of the package, and a corner protector magazine (2) comprising a storage space (3) fitted to store a number of corner protectors (4; $4^1$, $4^2$, $4^3$) arranged as a file in an upright position, said storage space being delimited in the downward direction by a bottom support (5) which supports the corner protectors from below, said storage space comprising a delivery end (6) from where an individual corner protector can be taken by the gripping and positioning device; conveying means (7, 8, 9, 10) for moving the file of corner protectors in the storage space toward the delivery end; and arresting means (11, 12, 13, 14, 15) arranged near the delivery end to arrest the corner protectors, characterized in that the conveying means comprise a press device (7) driven by a first power means (8) and arranged to be in contact with the hindmost corner protector ($4^3$) to move the file of corner protectors toward the delivery end (6) and to pack the corner protectors in the file substantially closely together;

and that the arresting means comprise a gate (11) which can be opened and closed, with an arrangement for moving the gate between a closed position (I) and an open position (II) using a second power means (12), in which closed position (I) the gate detains the file of corner protectors against the pressure applied by the press device as the foremost corner protector ($4^1$) leans against the gate, and in which open position (II) the gate is open so as to release the foremost corner protector to allow it to be taken by the gripping and positioning device, and an arresting device (13) disposed near the delivery end (6) and comprising a separating tab (14) fitted to be moved by a third power means (15) between an arresting position (A) and a releasing position (B), in which arresting position (A) the separating tab is between the foremost corner protector ($4^1$) in the file and the second corner protector ($4^2$) next in the file so as to arrest the file of corner protectors while the gate (11) is in the open position (II), and in which releasing position (B) the separating tab is out of the way of the corner protector ($4^2$) when the gate is in the closed position (I) so as to release the second corner protector to make it the foremost corner protector in the file so that it is pressed against the closed gate while the previous foremost corner protector is in the grip of the gripping and positioning device.

* * * * *